US005282883A

United States Patent [19]

Chaudhuri et al.

[11] Patent Number: 5,282,883

[45] Date of Patent: Feb. 1, 1994

[54] METHOD AND APPARATUS FOR THE HIGH-TEMPERATURE TREATMENT OF FINE-GRAINED SOLIDS IN A MELTING CYCLONE

[75] Inventors: Kiranenda Chaudhuri, Troisdorf-Sieglar; Gerhard Melcher, Cologne, both of Fed. Rep. of Germany

[73] Assignee: Kloeckner-Humboldt-Deutz AG, Fed. Rep. of Germany

[21] Appl. No.: 881,438

[22] Filed: May 11, 1992

[30] Foreign Application Priority Data

May 10, 1991 [DE] Fed. Rep. of Germany ..... 4115348

[51] Int. Cl.[5] ..... C22B 15/00

[52] U.S. Cl. ..... 75/639; 75/707; 266/182

[58] Field of Search ..... 75/639, 707, 453; 266/182, 172

[56] References Cited

U.S. PATENT DOCUMENTS

| | | | |
|---|---|---|---|
| 3,759,501 | 9/1973 | Foard | 266/182 |
| 4,665,842 | 5/1987 | Bartsch et al. | 266/172 |
| 4,976,776 | 12/1990 | Elvander et al. | 75/639 |
| 5,013,355 | 5/1991 | Elvander et al. | 75/707 |

*Primary Examiner*—Melvyn J. Andrews

*Attorney, Agent, or Firm*—Hill, Steadman & Simpson

[57] ABSTRACT

A method and apparatus for high temperature treatment of particulate metal ore concentrate solids with a cyclone having a tangentially positioned burner directing a jet flame into the cyclone, an ore injecting nozzle positioned to inject a stream of ore with oxygen containing gas into the jet flame of the burner at a location at least one-third of the travel of the flame and into the hottest region thereof so that the particles are melted and do not abrasively impact the walls of the cyclone in an unmelted stage.

18 Claims, 2 Drawing Sheets

METHOD AND APPARATUS FOR THE HIGH-TEMPERATURE TREATMENT OF FINE-GRAINED SOLIDS IN A MELTING CYCLONE

BACKGROUND OF THE INVENTION

The invention relates to improvements in methods and apparatus for the high temperature treatment of fine grained particular metal ore concentrate to obtain molten ore treatment temperatures.

More particularly, the invention relates to improvements in methods and constructions of a melting cyclone which is provided with burners for melting nonferrous metal ore concentrates and is provided with means for introducing the particulate nonferrous metal ore particles into the cyclone wherein the melt is separated from the exhaust gases under the influence of the cyclone.

For pyrometallurgical treatment of fine grained sulfidic ore concentrates in a melting cyclone, it is known such as in DE-AS 20 10 872 and German Published Application 33 35 859 to pneumatically convey fine grained solids to the cyclone in pipe conduits. The solids are introduced as a suspension with conveying air into the melting cyclone at high speeds through nozzles tangentially arranged in the jacket of the cyclone. The ore concentrate is continuously cycloned and melted in the eddy currents of the melting cyclone at high temperatures. As a consequence of the intense mass transfer between the gas and solids, high volatilization rates of the volatile solid constituents and the high melting rates of the nonvolatile constituents can be achieved in the cyclone. This known suspension melting in a cyclone has achieved special significance for the pyrometallurgical direct production of materials such as, for example, copper from sulfidic copper ore concentrates as well as from complex concentrates, yielding a comparatively pure crude copper and a low copper slag.

When the suspension of solids and conveying gas is introduced into the melting cyclone at high speeds (above 35/m/sec), the situation exists that the introduction nozzles for the fine grained solids will prematurely wear. Also, the solids particle will be pneumatically hurled into the melting cyclone with an appropriate pulse and will cause noticeable wear at the impact location against the fireproof lining of the inside cyclone wall. This is particularly true when the solids particles do not proceed to melt as they are blown into the cyclone and as a result, the inner surface of the melting cyclone will deteriorate so that shut down and repair must occur. With a melting cyclone in which fine grained solid materials are injected at high speed, the reaction time required for the reaction and melting of the particles is very short. As a practical matter, only the flight path of the particles from the injection nozzles to the inside cyclone wall is available for this reaction time and this can become too short so that exothermic calcining reaction collapses.

The risk is also present, as may be seen from German Patent 29 22 189, that the fine grained solids are introduced into the melting cyclone without conveying gas and without a vertical pulse from above and only on the basis of force of gravity. The particles are seized but not completely seized in the melting cyclone by the eddy currents and the oxygenous gas which is tangentially injected at high speed, and this results in the particles being partly hurled unreacted against the inside wall of the cyclone.

In known methods for pyrometallurgical treatment of fine grained sulfidic ore concentrates, such as sulfidic ore concentrates, for example, in a melting cyclone, the combustion of sulfide sulfur and potentially of other oxidizable constituents contained in the charged material in the oxygen atmosphere, usually supplies adequate heat in order to allow the calcining and melting process to proceed autogenously. With this situation, separate burners for the injection of fuels are not required in known melting cyclones.

An object of the invention is to provide a means for the high temperature treatment of pyrometallurgical fine grained ore concentration, particularly oxidic ore concentrates, where the melting process does occur autogenously in a melting cyclone but requires the employment of separate burners with fuel injection.

A further object of the invention is to provide for an improved method and apparatus for the temperature treatment of particulate metal ore concentration in a cyclone melting device which provides improvements over arrangements heretofore available.

A further object of the invention is to provide an improved method and structure for high temperature treating of particulate metal ore concentrates in a melting cyclone wherein the particulate material can react as completely as possible at high melting rates with the lowest possible melting cyclone wear.

A further object of the invention is to provide an improved method and apparatus for the high temperature treatment of particulate metal ore concentrates in a melting cyclone wherein losses of the gas dust and reduced specific energy consumption are achieved.

FEATURES OF THE INVENTION

In accordance with the principles of the invention, a method is provided for the pyrometallurgical treatment of fine grained ore concentrates in a melting cyclone where the melting process does not autogenously occur in the cyclone. That is, when the sulfide sulfur content contained in the sulfidic ore concentrate is inadequate or when the ore concentrate employed is oxidic (for example, manganese ore concentrate, platinum ore concentrate, etc.) whereby the oxidic ore concentrate should be melted in the melting cyclone and be at least prereduced. In these cases, fuel in the form of an open burner jet is injected into the melting cyclone through at least one burner, whereby the heat arising due to the burning of the fuel supplies the heat necessary for implementing the melting and reaction work for the ore concentrate.

According to the invention, the solid particles of ore concentrate are blown directly into the open burner in the hottest region thereof. This is done with a high particle beam speed that the solid particles penetrate into the burner jet. Optimum results for a maximum dwell time and optimally complete reacting of the solids material to be pyrometallurgically processed in the cyclone, as well as for optimally low losses of exhaust gases below 3% have been found when the solids particle jet is composed of ore concentrate and additives which are directly insufflated from above at a speed in the range of 3.5 m./sec. through approximately 8 m./sec. These are injected into the burner jet which is laterally insufflated into the melting cyclone at a path which is tangential to the inner surface of the cyclone. The burner jet is laterally introduced with an exit speed of the burner jet at the orifice of the burner on the order of more than 100 m./sec. Such a burner would frequently be a coal dust burner. If the solids particle flow were dropped into the cyclone, with the force of gravity, it would not be capable of penetrating into the burner jet. The solids particle would dance on the burner jet flame resulting in an inadequate melting and an inadequate reacting of the solid particles. Operation also would be not be satisfactory if the solids particles were transversely blown through the burner jet or through the flame with too high a speed or with a too great a vertical pulse. If inadequate reaction occurs, the remaining particles which are not melted will be permitted to engage the walls of the cyclone with an abrasive result and with the result that inadequate melting and inadequate reaction occurs and efficiency suffers.

The stream of solids particles in accordance with the present invention should penetrate into the burner jet flame in the hottest region thereof. It has been determined that this impact location or penetration location should be where the burner jet has already transferred at least one-third of its overall path which is the tangent path in the vertical melting cyclone. The burner jet is still closed at this location and its pulse is significantly high. As a result of the direct insufflation of the solids particle into the hottest region of the burner jet flame, the probability that all the solids particles will melt and react in the melting cyclone is enhanced. That is, the risk of unmelted solid particles will impact the inside wall of the cyclone or be entrained with exhaust gas dust is diminished. As a result of the more complete reaction of the solid particles, that is, melting, calcining or reducing, the oxygen exploitation is higher and only a small amount of free oxygen remains in the exhaust gas of the melting cyclone. For example, 0.1% through 3% of $O_2$ in the exhaust gas remains in comparison of up to 6% of $O_2$ which occurs with devices heretofore available such as where the solid material is laterally injected into the cyclone at high speed. Further, advantages are gained with comparatively low nozzle wear as well as high useful life of the melting cyclone and these advantages accompany the relatively low insufflation speed of the solid particles in accordance with the method of the invention. While the preferred arrangement provides for tangential injection of the burner jet flame and overhead insufflation of the solids into the hottest point of the flame, it is contemplated that a burner jet can be introduced into the cyclone from above with the stream solids insufflated laterally into the burner jet into the hottest region thereof.

Other advantages, features and objectives will become more apparent with the teaching of the principles of the invention in connection with the disclosure of the preferred embodiment thereof in the specification, claims and drawing in which:

DESCRIPTION OF THE PREFERRED EMBODIMENTS

Figure 1:
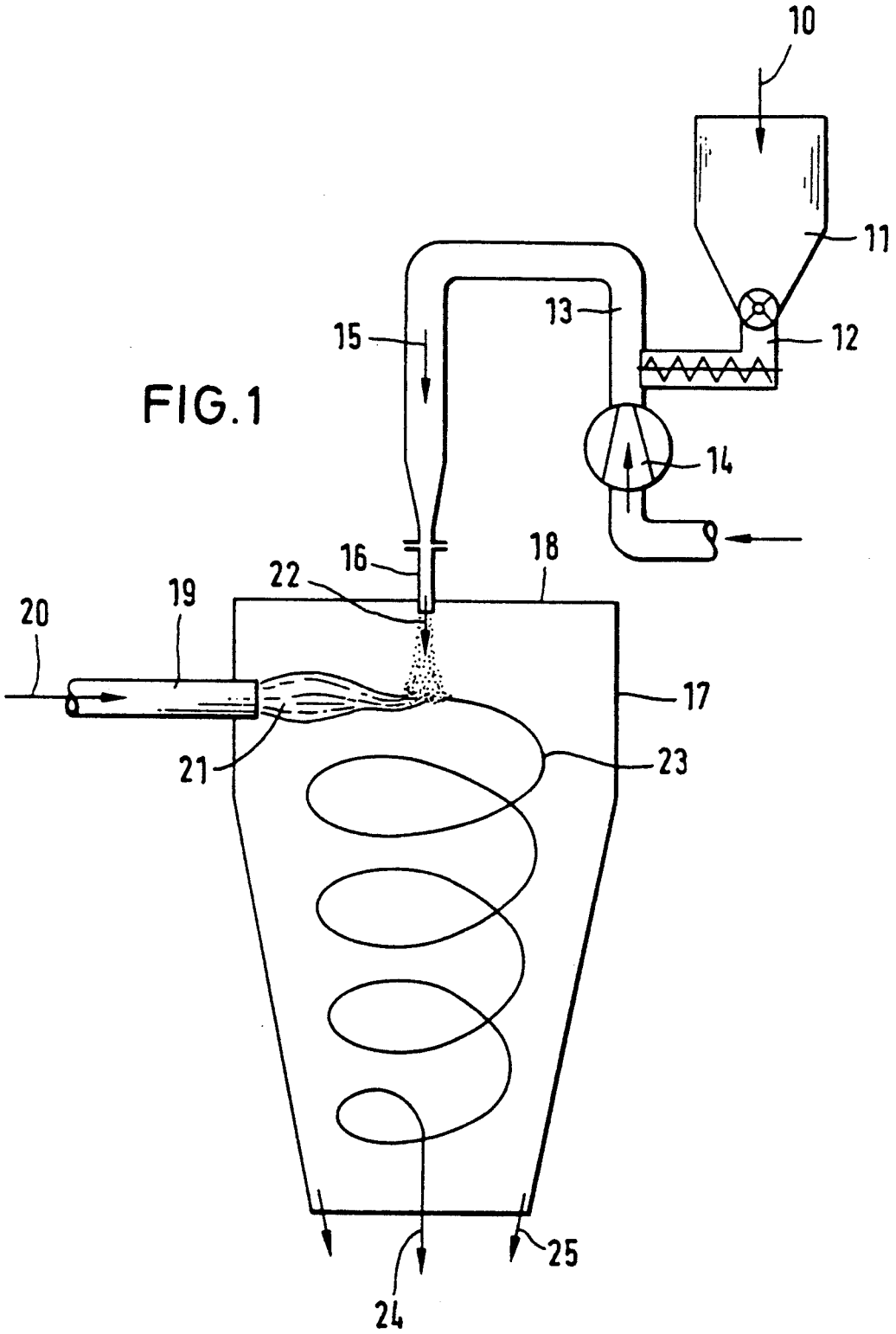
FIG. 1 is a vertical sectional view taken through a melting cyclone for the pyrometallurgical processing of fine grained ore concentrate, with the drawing shown in somewhat schematic form.

As illustrated in FIG. 1, a fine grained ore concentrate is provided at 10 together with additives such as slag forming agents. There also be may be included potentially auxiliary fuel such as coal dust. The mixture of materials is continuously supplied from a supply bunker 11 via a metering device 12 into a pressure line 13. The line 13 is pressurized by a compressor 14 which provides for the pneumatic conveying of the suspension of solids through the pressure line 13. Air or oxygen enriched gas can be employed as conveying gas for the pneumatic conveying of the fine grained solids. The suspension of solids flows as indicated by the arrowed 15, and this suspension with carrier gas is insufflated from above into a melting cyclone 17 through an upper wall 18 thereof via a nozzle 16. The insufflation occurs at an exit speed in the range of 3.5 m./sec. through approximately 8 m./sec.

A burner 19 is positioned to laterally direct a flame into the melting cyclone 17 which is positioned vertically. The burner 19 is supplied with fuel 20, such as coal dust, and with primary air and potentially secondary air or oxygen enriched gas. The burner has a flame jet and the exit speed of the fuel at 21 of the burner orifice is in the order of 150 m./sec.

The overhead nozzle provides a stream 22 of solids and the nozzle 16 is located so that the stream of solid particles is insufflated directly from above into the hottest zone of the burner flame jet 21. The solid particles will penetrate into the burner jet. The stream 22 of solid particles impacts the burner jet at a specific location at which the burner jet is at its hottest point. This is a location where the burner jet has already transversed at least one-third of its overall tangent path relative to the wall of the melting cyclone, and this is illustrated generally by the location of burners **19*a*, 19*b*, 19*c* and 19*d* in FIGS. 2 through 4**.

The solid particles 22 introduced from above into the melting cyclone are completely melted with instantaneous heating to high temperatures in the hottest part of the burner flame. The temperatures at that point will be on the order of 1600° C. and melting will occur in fractions of a second while the particles are still in flight or in an eddy condition as illustrated by the line 23. These are interdependent of the atmosphere to be controlled via the partial oxygen pressure in the melting cyclone and the particles are subjected to a chemical reaction.

At the underside of the melting cyclone 17, low dust exhaust gas is withdrawn at the arrowed line 24 separately from the molten particles which migrate helically downwardly as indicated by the arrowed line 25 being as a melt film on the inside wall of the melting cyclone.

Figure 2:
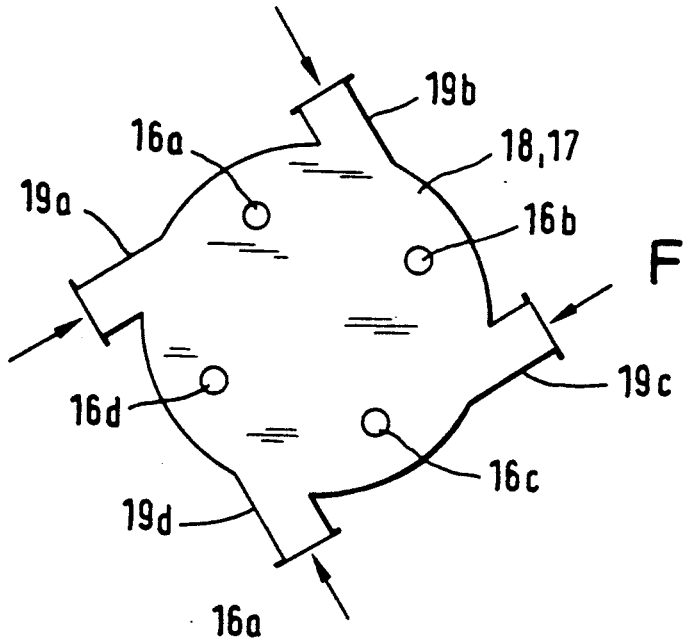
FIG. 2 is a plan view of the melting cyclone illustrating an alternate form of insufflating particles at plural locations with plural burners.

With reference to FIG. 2, a plurality of ore injecting nozzles **16*a*, 16*b*, 16*c* and 16*d* may be provided. FIG. 2 illustrates four such nozzles which are circumferentially distributed over the top of the cyclone for the insufflation of fine grained solids material. The location of the insufflation nozzles is interdependent with the location of the burners 19*a* through 19*d*** which are circumferentially spaced over the circumference of the cyclone.

Figure 3:
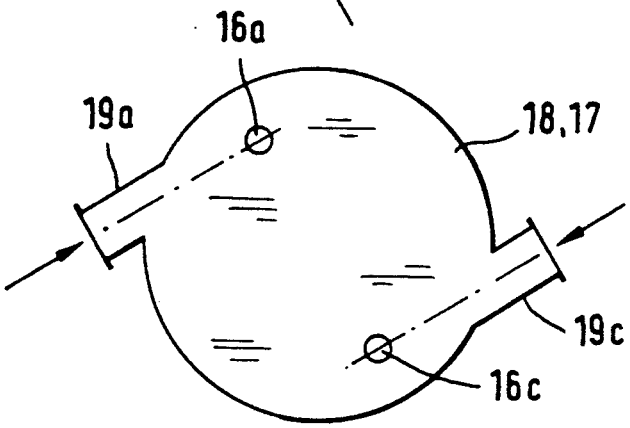
FIG. 3 is a horizontal cross-sectional view taken through the melting cyclone of FIG. 2 at a different horizontal level.
Figure 4:
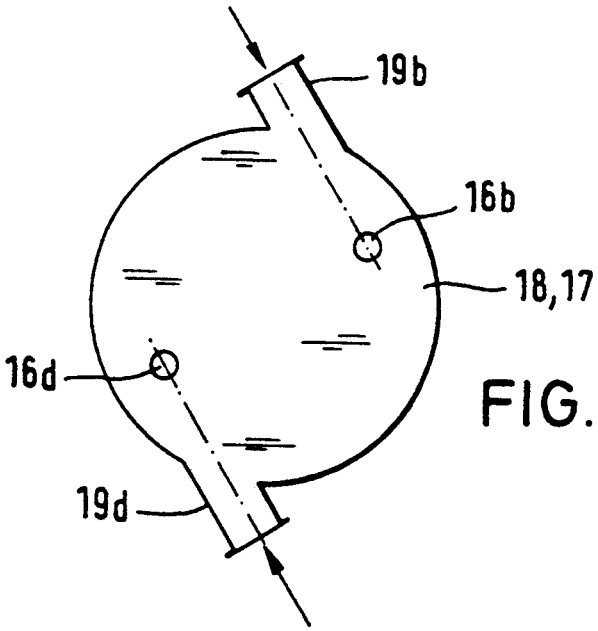
FIG. 4 is a horizontal cross-sectional view taken through the melting cyclone of FIG. 2 at a different horizontal level.

In addition to being circumferentially spaced, the burner jets **16*a* through 16*d* can be located at different vertical levels. As illustrated by FIG. 3 which illustrates one level, burners 19a and 19c are positioned 180° apart. As illustrated in FIG. 4, burner jets 19b and 19d** are located at a lower location on the wall of the cyclone. The burner jets are each positioned relative to the insufflation particle nozzles so that a particle nozzle is positioned for each burner to direct the insufflation flow of particulate material and gas into the hottest point of a burner.

The burner jets are positioned and angled so that the burner flame emerging from the jets extend into the cyclone tangent to the cyclone wall. This, of course, enhances the operation of the cyclone and while the burner flames carry the molten particulate material onto the cyclone wall, the material is molten by the time it reaches the wall so that abrasive engagement is avoided.

Numerical Example

| Concentrate Mix 10 | |
|---|---|
| 23–24 Wt. | — % Cu |
| 21–22 Wt. | — % Fe |
| 26–28 Wt. | — % S |
| 14–19 Wt. | — % ($SiO_2$ + $Al_2O_3$ + CaO) |
| 2–3 Wt. | — % Zn |
| 0.5–1 Wt. | — % Pb |
| 0.5–1 St. | — % As |

Melting results achieved in a trial system, particulars referred to 1,000 kg concentrate mix:

Oxygen through the burner 19 (95% $O_2$ purity): 307–334 $Nm^3/t$ concentrate mix Solids carrier agent or, respectively, reaction air: 206–300 $Nm^3/t$ concentrate mix Fuel through the burner 19 ($CH_4$): 92 $Nm^3/t$ concentrate mix Heat losses of the melting cyclone 17: 15 through 25% of the introduced heat Ratio of dust in the exhaust gas 24: 21 through 27 kg/t ($\approx$2.1 through 2.7%)

Oxygen content in the exhaust gas 24: 0.3 through 2.8 volume %

Copper content of the settled crude copper phase: 59 through 65 wt. %

Copper content of the settled slag phase: 0.7 through 1.0 wt. %

In the foregoing example, the crude copper phase was separated from the slag phase without further after-treatment in a settling hearth arranged after the melting cyclone. Comparatively low copper content of the settled slag phase, despite the presence of the comparatively high copper content of the settled crude copper phase is unexpected. The magnetite content of the slag phase lay between 5% through 7% by weight.

Thus, it will be seen that there have been provided an improved apparatus and method for the treatment of fine grained solids in a melting cyclone which meets the objectives and advantages above set forth and provides improved economy and efficiency, and longer cyclone wear than with arrangements heretofore available.

We claim as our invention:

1. A method for the high temperature treatment of particulate metal ore solids to provide molten products comprising the steps:

insufflating particulate metal ore concentrates into a vertical melting cyclone having a vertical central axis and an outer circumferential conical wall forming a chamber with an oxygen containing gas with said gas flowing in gas currents in the cyclone chamber and melting the ore in the gas currents of the cyclone forming molten ore from the ore concentrates with molten ore separating from gases in the cyclone;

burning a fuel in the chamber by a burner directed horizontally into the cyclone forming a burning jet flame with said flame having a hottest portion of maximum temperature and said flame traveling in a path from a point of entry into the cyclone to a location within the cyclone; and insufflating the ore vertically into the chamber at said hottest portion of the jet flame at an insufflation particle speed in the range of 3.5 m/sec. through 8 m/sec. to penetrate the burner jet flame so that said ore concentrates are melted and do not abrasively impact the wall of the cyclone in an unmelted stage.

2. A method for the high temperature treatment of particulate metal ore solids to provide molten products in accordance with the steps of claim 1:

wherein a plurality of burners are provided at different vertical levels of the cyclone with separate insufflating ore nozzles for each of the burners each directing the ore into the hottest portion of the jet flame of a burner.

3. A method for the high temperature treatment of particulate metal ore solids to provide molten products in accordance with the steps of claim 1:

wherein said plurality metal ore concentrates are insufflated vertically with a speed of a stream of the ore exceeding 35 m/sec. into the burner jet flame.

4. A method for the high temperature treatment of particulate metal ore solids to provide molten products in accordance with the steps of claim 1:

wherein the burning jet flame is introduced laterally of the cyclone axis into the melt cyclone chamber with an exit speed in excess of 100 m/sec. such that the jet flame forms a tangent with the circumferential wall of the cyclone.

5. A method for the high temperature treatment of particulate metal ore solids to provide molten products in accordance with the steps of claim 1:

wherein the metal ore concentrates impact the jet flame at a point where said flame has traversed at least one-third of an overall path in the cyclone.

6. A method for the high temperature treatment of particulate metal ore solids to provide molten products in accordance with the steps of claim 1:

including directing the burner into the cyclone tangentially to an inner surface of the wall of the cyclone;

and pressurizing the ore and directing the particulate metal ore concentrate to intersect with the jet flame under pressure.

7. A method for the high temperature treatment of particulate ore solids to provide molten products in accordance with the steps of claim 6:

wherein the gas and the particulate metal ore concentrates are each directed into the cyclone through a nozzle and the ore concentrates are pressurized to have exit speed from the nozzle in the range of 0.5 m./sec. through 8 m./sec.

8. A method for the high temperature treatment of particulate metal ore solids to provide molten products in accordance with the steps of claim 1:

wherein said jet flame is directed into the cyclone through a burner orifice at an exit speed on the order of 150 m/sec.

9. A method for the high temperature treatment of particulate metal ore solids to provide molten products in accordance with the steps of claim 1:

wherein the particulate metal ore concentrate includes the following ingredients in the concentrate mix, 23–24 Wt. - % Cu, 21–22 Wt. - % Fe, 26–28 Wt. - % S, 14–19 Wt. - %, ($SiO_2+Al_2O_3+CaO$), 2–3 Wt. - % Zn, 0.5–1 Wt. - % Pb, 0.5–1 Wt. - % As.

10. An apparatus for the high temperature treatment of particulate metal ore concentrate solids, comprising in combination:

a vertically conically shaped cyclone having a vertical axis, an enclosing wall with an inner surface and an upper end and a tapered lower end;

a plurality of fuel burners arranged circumferentially at the upper end of the cyclone positioned to direct jet flames at a flame length tangentially to the inner surface of the wall of the cyclone;

a plurality of circumferentially spaced ore injecting nozzles positioned above the burners and located to direct streams of ore particles into the jet flames at a location in excess of at least one-third of the length of the burner jet flames, said nozzles constructed to inject ore at a speed in the range of 3.5 m/sec. through 8 m/sec.;

a compressor connected to the ore injecting nozzles;

means for collecting molten ore particles gathering on the inner surface of the wall of the cyclone;

means for collecting gas flowing axially downwardly from the cyclone;

and means connected to the ore nozzles for providing a supply of ore particles to the ore nozzles to be directed into the cyclone.

11. An apparatus for the high temperature treatment of particulate metal ore concentrate solids comprising in combination:

a melting cyclone having a vertical central axis and a surrounding conical wall having an inner surface forming a cyclone chamber with a top end and tapering downwardly;

a burner positioned adjacent the cyclone wall to inject a burning fuel horizontally into the cyclone chamber generating a flame directed into the cyclone chamber forming a burning jet flame;

and an ore injecting nozzle positioned adjacent the cyclone wall to inject a stream of ore particles vertically downwardly into the jet flame substantially at a location to penetrate the jet flame so that the particles are melted and do not abrasively impact an inner surface of the wall of the cyclone in an unmelted stage, said nozzle constructed to inject particles at a velocity in the range of 3.5 m/sec. through 8 /sec.

12. An apparatus for the high temperature treatment of particulate metal ore concentrate solids constructed in accordance with claim 11:

wherein said burner is positioned to inject the burning fuel laterally and tangentially to the inner surface of the wall of the cyclone.

13. An apparatus for the high temperature treatment of particulate metal ore concentrate solids constructed in accordance with claim 11:

including a plurality of burners spaced circumferentially outwardly of the wall around the cyclone wall with an ore injecting nozzle for each of the burners.

14. An apparatus for the high temperature treatment of particulate metal ore concentrate solids constructed in accordance with claim 11:

including a compressor connected to said ore nozzle for compressing said ore particles to direct the ore particles in a path to penetrate the jet flame.

15. An apparatus for the high temperature treatment of particulate metal ore concentrate solids constructed in accordance with claim 11:

including a compressor connected to said ore nozzle wherein the ore particles are pressurized before directing through the ore injecting nozzle, said compressor having a capacity to obtain a stream speed in the range of 3.5 m/sec. through approximately 8 m/sec.

16. An apparatus for the high temperature treatment of particulate metal ore concentrate solids constructed in accordance with claim 11:

wherein said burner has a capacity to direct pressurized fuel into the cyclone with an exit speed of above 100 m/sec. with the burner flame extending tangentially to the inner surface of the cyclone.

17. An apparatus for the high temperature treatment of particulate metal ore concentrate solids constructed in accordance with claim 11:

wherein said burner is located adjacent the cyclone wall and positioned to direct burner fuel tangentially into the cyclone relative to the wall of the cyclone and the ore injecting nozzle projects in a direction parallel to the axis to inject the stream of ore into the jet flame.

18. An apparatus for the high temperature treatment of particulate metal ore concentrate solids constructed in accordance with claim 11:

including plural burners positioned at different vertical levels in the cyclone and ore injecting nozzles each in alignment with one of the burners positioned for directing a stream of ore particles at the hottest portion of the jet flame.

* * * * *